US005566733A

United States Patent [19]

Germain

[11] Patent Number: 5,566,733

[45] Date of Patent: Oct. 22, 1996

[54] APPARATUS FOR DELIVERING, AT HIGH FREQUENCY, MEASURED QUANTITIES OF LIQUID

[75] Inventor: Jean-Pierre Germain, Montigny le Bretonneux, France

[73] Assignee: L'Air Liquide, Societe Anonyme pour l'Etude et l'Exploitation des Procedes George Claude, Paris Cedex, France

[21] Appl. No.: 341,140

[22] Filed: Nov. 16, 1994

[30] Foreign Application Priority Data

Dec. 1, 1993 [FR] France ..... 93 14341

[51] Int. Cl.[6] ..... B65B 1/30; B65B 3/28

[52] U.S. Cl. ..... 141/192; 141/102; 141/115; 141/157

[58] Field of Search ..... 141/50, 67, 70, 141/102, 115, 192, 196, 285, 301, 302, 305, 94, 83, 130, 129, 156, 157, 85, 86

[56] References Cited

U.S. PATENT DOCUMENTS

| | | | |
|---|---|---|---|
| 3,951,186 | 4/1976 | Mencacci | 141/70 |
| 4,202,387 | 5/1980 | Upton | 141/360 |
| 4,350,186 | 9/1982 | Schalkowsky et al. | 141/83 |
| 4,460,026 | 7/1984 | Hurley et al. | 141/1 |
| 4,790,359 | 12/1988 | Whitford | 141/67 |
| 5,131,440 | 7/1992 | Quinn | 141/67 |

FOREIGN PATENT DOCUMENTS

| | | |
|---|---|---|
| 0479559 | 4/1992 | European Pat. Off. . |
| 2310479 | 12/1976 | France . |

*Primary Examiner*—Henry J. Recla
*Assistant Examiner*—Steven O. Douglas
*Attorney, Agent, or Firm*—Young & Thompson

[57] ABSTRACT

Two electrovalves (7A, 7B) are grouped in a same block (7) and disposed in parallel between a supply conduit (5) and a distribution conduit (6). Each electrovalve is provided with a micrometric adjustment screw (9A, 9B) which can be actuated from outside the block. When one of the electrovalves is in operation to deliver successive identical quantities of liquid, the other electrovalve is adjusted as a function of a new value and, during changeover, it suffices to switch the electrovalves. The same block (7) can contain a third electrovalve (7C) for blowing gas under pressure to expel the remaining drops within the distribution conduit. The liquid and the gas are two phases of the same fluid.

3 Claims, 2 Drawing Sheets

APPARATUS FOR DELIVERING, AT HIGH FREQUENCY, MEASURED QUANTITIES OF LIQUID

BACKGROUND OF THE INVENTION

The present invention relates to an apparatus for delivering, at high frequency, measured quantities of liquid.

DISCUSSION OF THE RELATED ART

In various fields of technology, it is necessary to deliver small measured quantities of liquid at high frequency. This is the case, for example, when it is desired to introduce a small quantity of liquid into receptacles, such as containers of food or of beverages passing at high speed below a distribution station. The liquid can be an additive to the contents of the receptacle, however the invention has been practiced with the object to introduce into receptacles a small quantity of liquid nitrogen, so as to effect an instantaneous cooling, as well as providing an inert atmosphere, before closing the receptacle.

There can be used, for the object indicated above, an apparatus comprising an electrovalve having an inlet and an outlet, and provided with adjustment means permitting adjusting with precision the flow passing through the electrovalve when it is open, a supply conduit connecting the source of liquid to the inlet of the electrovalve, and a distribution conduit connected to the outlet of the electrovalve and emptying outside where the liquid must be delivered, the apparatus comprising moreover a control apparatus which delivers signals controlling the opening and closing of the electrovalve according to a preestablished program.

The control apparatus permits obtaining opening times that are precisely reproducible, while the adjustment means permits, by adjusting the flow rate, introducing into each receptacle a quantity of liquid that is substantially identical to that which is desired.

It is thus possible to obtain a precise and constant dosage, while maintaining extremely high frequencies, without the introduction of small quantities of liquid through the apparatus described slowing the speeds of passage.

However, a problem arises upon converting from one series of receptacles into which a predetermined quantity of liquid must be introduced, to another series of receptacles in which must be introduced a different quantity of liquid. Thus, a change of the open time of the electrovalve, by means of the control apparatus, does not generally permit obtaining sufficient precision for the opening and closing times, and it is necessary to stop the line to effect an adjustment of the control means of the electrovalve. This gives rise, as a result, to a loss of time which impacts on all the installation.

SUMMARY OF THE INVENTION

The present invention has for its object to overcome this problem, and to provide an apparatus which permits, in a substantially instantaneous way, a change of quantity of liquid distributed each time.

To obtain this result, the invention provides a device of the type indicated above, and which has the particularity that it comprises a pair of a first and a second electrovalves mounted in parallel between the supply conduit and the distribution conduit, and a commutation apparatus interposed between the control apparatus and the two electrovalves to actuate as desired one or the other of the electrovalves.

The mode of operation will be easily understood: while a series of identical dosages is being delivered, by utilizing, for example, the first electrovalve, the operator may, without being pressed for time, control the adjustment means of the second electrovalve, and during changing over, it suffices to actuate the commutation apparatus so that the dosages corresponding to the second value changed over will be delivered. The operator can then actuate the adjustment means of the first electrovalve to prepare for the delivery of dosages corresponding to a third value, and so on.

Of course, the operations can be programmed and automated, which is to say that the actuation of the adjustment means can be controlled in an automatic way by means of a preestablished program, and the actuation of the commutation apparatus can be triggered by a detector which is sensitive, for example, to an index or to a change of shape or of color of the passing receptacles.

BRIEF DESCRIPTION OF THE DRAWINGS

The invention will now be described in a more detailed manner with the aid of a practical example, illustrated in the drawings, in which.

DESCRIPTION OF THE PREFERRED EMBODIMENT

Figure 1:
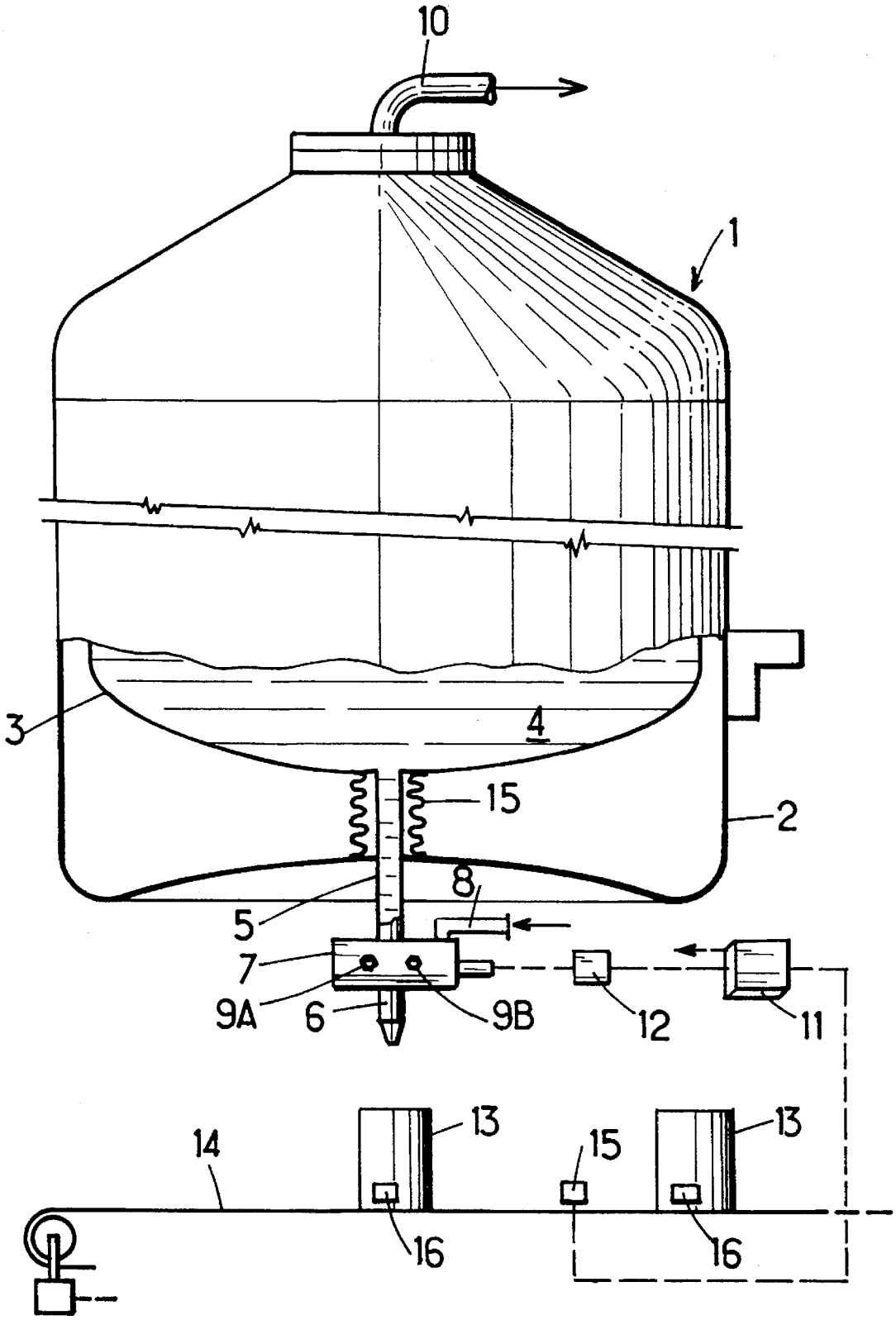
FIG. 1 is an assembly view of an installation comprising an apparatus according to the invention to distribute liquid nitrogen into passing receptacles.
Figure 2:
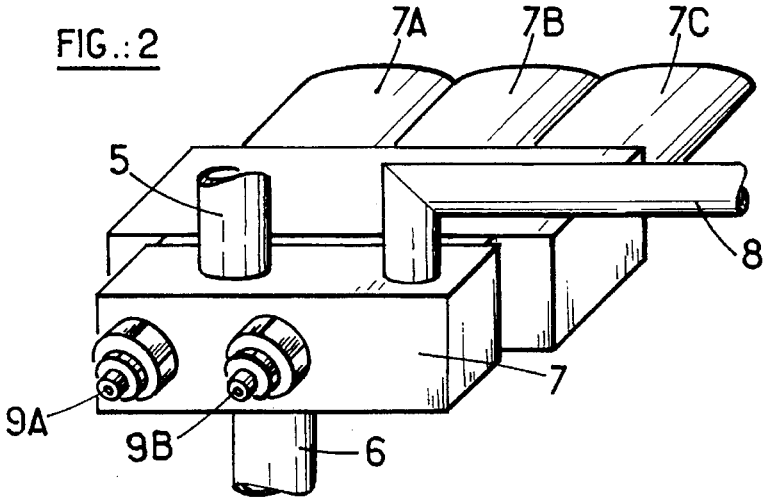
FIG. 2 is an enlarged front view of the block 7 and FIG. 3 is a theoretical diagram of block 7.

In FIG. 1, there is seen a cryogenic reservoir 1 comprising, in a conventional manner, an external shell 2 and, thermally insulated within this latter, an internal shell 3 defining an internal chamber for the storage of a quantity of liquified gas 4 surmounted by a gaseous sky. The device according to the invention comprises a liquid supply conduit 5, opening into the internal shell 3 and a short downstream or distribution conduit 6 separated by the cryogenic electrovalve block 7. Into the block 7 also opens a gas conduit 8 connected to a source of gas under pressure, preferably the gaseous phase of the cryogenic fluid contained in the reservoir 1, available from a conduit 10 communicating with the gaseous sky of the internal shell 4 or, if desired, with an internal coil for vaporization of the liquified gas 4.

Figure 3:
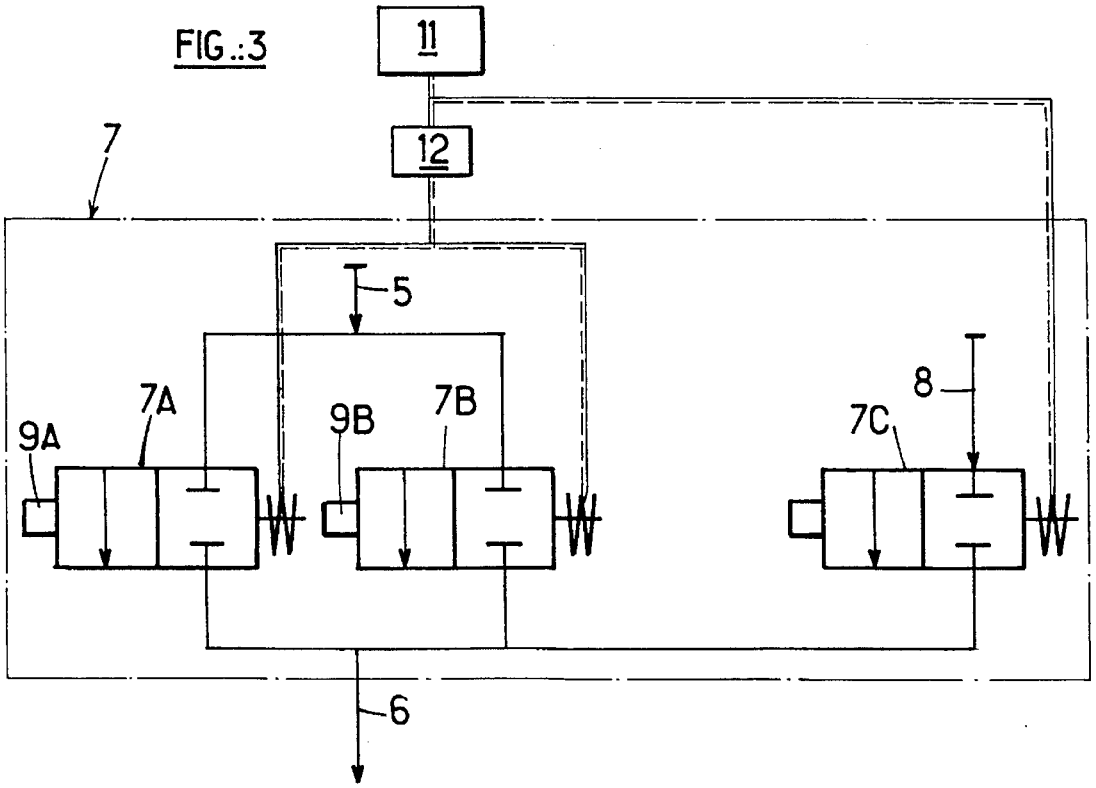

FIG. 3 shows the theoretical scheme of block 7. It will be seen that it contains three electrovalves: two electrovalves 7A, 7B are disposed in parallel between the liquid supply conduit 5 and the distribution conduit 6, while the third electrovalve 7C is disposed between the gas conduit 8 and the same distribution conduit 6. There is designated at 9A and 9B micrometric screws for the adjustment of electrovalves 7A and 7B, which can be controlled externally. The micrometric adjustment screw of the gas electrovalve 7C, which in principle does not need to be adjusted frequently, is not accessible from the exterior in the illustrated example, but it is possible that it also could be.

The electrovalves are connected to an electronic control unit 11, by means of a switch 12 disposed between the control unit 11 and the two electrovalves 7A, 7B for a liquid, the electrovalve 7C for gas being connected directly to the electronic control unit.

The structure of the control unit 11 is conventional and known to those skilled in the art. A suitable example of a control unit, which can be used in the framework of this invention, is commercialized by SUNX under the reference NPS CT7.

The quantity of nitrogen to be delivered in each container depends on the gaseous phase in the container and the time between filling and closing it. The amount of nitrogen delivered in each container is preset by controlling the opening duration of the electrovalve 7A; this duration can be preset by controlling a timer situated on the front of the control unit. The SUNX amplifier is connected to the beam sensor detection system, e.g., when the sensor detects a container, the electrovalve 7A is opened for a preset period of time, whereas electrovalve 7B is closed and can be preset to a second duration.

When an electrovalve opens, the preset quantity of liquid nitrogen is ejected into the container from the electrovalve by the gaseous nitrogen.

As shown in FIG. 1, the ensemble of the reservoir 1 and of the distribution system is disposed above a path for receptacles 13 driven by a conveyor 14. A detector 15 is disposed adjacent to the path of the receptacles 13, and is sensitive to indications given by the index 16 carried by the receptacles.

The cycle of operation of the apparatus which has been described is as follows: one of the liquid electrovalves, 7A for example, is open for a predetermined period of time, typically of the order of several hundredths of a second, to permit to flow a measured quantity of the liquid contained in the upstream portion of the conduit 5 and to pour this predetermined quantity into a receptacle 13 passing below the upstream portion of the distribution conduit 6. The electrovalve 7A is then closed and, after a very small interval of time, of the order of 10 thousandths of a second, the electrovalve 7C is opened, for a predetermined period of time, typically of the order of 2 one-hundredths of a second, to sweep the downstream portion of the distribution conduit 6 and thus to expel the drops of liquid located in this downstream portion. The duration of opening of the electrovalve 7C is selected to stabilize the temperature in the downstream portion of the conduit 6 and thus the quantity of liquid nitrogen which is vaporized there during the following injection. The opening of the electrovalves is adjustable as a function of the dimensions of the receptacles 13 and their operation is synchronized by the control unit 11, via detection signals of the presence of the receptacles 13 and/or of the speed of advance of these latter. In mass production, the total duration of a cycle can be reduced to 0.05 second.

When the indication given by the index 16 changes, the detector 15 sends a signal which is transmitted, by means of the control 11, to activate the electrovalve 7B in place of the electrovalve 7A, or vice versa.

I claim:

1. In an apparatus to deliver, at high frequency, measured quantities of liquid, comprising electrovalve means (7A, 7B) having an inlet and an outlet, and provided with an adjustment means (9A, 9B) permitting adjusting with precision the flow passing through the electrovalve means when the electrovalve means is open, a supply conduit (5) connecting the inlet of the electrovalve to a source of liquid, a distribution conduit (6) connected to the outlet of the electrovalve means and opening where the liquid is to be delivered, and control means (11) controlling the opening and the closing of the electrovalve means; the improvement wherein the electrovalve means comprises first and second electrovalves (7A, 7B) mounted in parallel between the supply conduit (5) and the distribution conduit (6), switching means (12) interposed between the control means and the first and second electrovalves to actuate selectively one of said first and second electrovalves, and a third electrovalve (7C), disposed between a gas supply conduit (8) connected to a source of gas under pressure and the distribution conduit (6), said third electrovalve being controlled by the control means (11) to control the opening and closing of said third electrovalve according to a program such that said gas under pressure is delivered into the distribution conduit (6) after the closing of the first or the second electrovalve, so as to expel drops of liquid remaining within the distribution conduit.

2. Apparatus according to claim 1, wherein the adjustment means (9A, 9B) of each of said first and second electrovalves (7A, 7B) are remotely controlled as a function of a preestablished program.

3. Apparatus according to claim 1, wherein the liquid and the gas are the two phases of a same fluid.

* * * * *